US006195966B1

(12) United States Patent
Shomron et al.

(10) Patent No.: US 6,195,966 B1
(45) Date of Patent: Mar. 6, 2001

(54) APPARATUS AND METHOD FOR MAKING POUCHES

(75) Inventors: Ari Shomron, Moshav Beit Yitzhak; Hasdi Matarasso, Netanya, both of (IL)

(73) Assignee: Nova-Tek Technologies, Ltd., Tel Aviv (IL)

( * ) Notice: Subject to any disclaimer, the term of this patent is extended or adjusted under 35 U.S.C. 154(b) by 0 days.

(21) Appl. No.: 09/236,735

(22) Filed: Jan. 25, 1999

(30) Foreign Application Priority Data

Jan. 25, 1998 (IL) ..... 123041

(51) Int. Cl.[7] ..... B65B 9/02
(52) U.S. Cl. ..... 53/451; 53/553
(58) Field of Search ..... 53/389.4, 450, 53/451, 459, 550, 553, 568

(56) References Cited

U.S. PATENT DOCUMENTS

| | | | | |
|---|---|---|---|---|
| 3,596,428 | * | 8/1971 | Young et al. | 53/553 |
| 3,735,551 | * | 5/1973 | Pratt | 53/553 |
| 5,345,750 | * | 9/1994 | Gries et al. | 53/553 |
| 5,454,208 | * | 10/1995 | Kawano | 53/451 |
| 5,459,980 | * | 10/1995 | Kenney et al. | 53/553 |
| 5,740,661 | * | 4/1998 | Yamaguchi et al. | 53/553 |

OTHER PUBLICATIONS

German Abstract of DE 37 05 167 "Multi–Chamber Inflatable Bag," along with equivalent English Derwent Abstract of WO 88/06131.

German Abstract of DE 25 56 968 "Thermoplastic Film Bags Manufacturing System," along with corresponding English Derwent Abstract.

German Abstract of DE 32 14 716 "Plastics Film Bag Machine for Shop Counters," along with corresponding English Derwent Abstract.

German Abstract of DE 36 13 117 "Automatic Envelope Folding Machine," along with corresponding English Derwent Abstract.

* cited by examiner

*Primary Examiner*—Stephen F. Gerrity
(74) *Attorney, Agent, or Firm*—Marshall, O'Toole, Gerstein, Murray & Borun

(57) ABSTRACT

A device and method for forming plastic pouches, the device including a source of at least two substantially superposed layers of plastic sheet, a pair of rollers for selectively advancing the layers of plastic sheet, a plastic filling element, and heat welding means for sealing open sides of the pouches, wherein portions of a longitudinal half of each of the rollers have a larger radius than the remainder of the roller whereby, when the larger radius portions of the rollers engage one another, they advance the plastic held between them, and when the smaller radius portions of the rollers are in registration with one another, they do not engage the plastic between them, so the plastic does not advance and can be heat sealed.

21 Claims, 7 Drawing Sheets

APPARATUS AND METHOD FOR MAKING POUCHES

FIELD OF THE INVENTION

The present invention relates to apparatus for forming plastic pouches, air cushions, and plastic envelopes.

BACKGROUND OF THE INVENTION

When packing fragile objects in boxes for shipping or storage, it is often desirable to surround the objects with protective elements which absorb shocks and insulate the objects to prevent damage. Today the most commonly used materials are shaped styrofoam, styrofoam peanuts, shredded paper, urethane foam as used in foam-in-place systems, foam chips, corrugated inserts, or similar items which are light in weight yet absorb shocks. When packing other objects, it is common to add such materials between a container and its contents for void filling. The disadvantage of such items is that they are large in volume, so require a large storage space before use, many of them are environmentally unfriendly, and some are difficult to dispose of. Small items, such as peanuts, tend to sink to the bottom of a box, thereby leaving upper portions of the object packed therein uncovered and unprotected.

Instead of such materials, it has been suggested to use air cushions, also known as air pillows and air bags, for protecting fragile objects and for void filling. These are small plastic bags which are stored in roll form and inflated in the factory as needed. Thus, they require little storage space. However, conventional air cushion machines are complicated and expensive.

One example of a conventional machine for making air cushions operates using a compressor to provide pressurized air to inflate the cushions. Plastic sheaths sealed on both side edges are provided on a roll. The plastic is advanced between two rollers which grip the plastic between them and advance the plastic sheath as they rotate. When they stop rotating, typically by means of a sensor reading a coded symbol printed on the plastic, the sheath is held still. The sleeve is punctured and filled with air, and then the plastic is sealed at both ends, hopefully sealing the puncture at the same time.

Other known devices include a microprocessor for controlling the filling and sealing of the air cushions. These utilize a computerized system to measure the length of the cushion and send a signal to stop advancing the plastic sheath.

These devices are costly, and require precision in the operation of the sensor for stopping the advance of the plastic, as well as accuracy in sealing the cushions. Furthermore, changing the length of the cushions requires printing new rolls of plastic with the symbols for the end of the cushion located a different distance apart.

Accordingly, there is a long felt need for a relatively inexpensive device for making air cushions, and it would be very desirable to have such a device which is simple to manufacture and operate and wherein the length of the cushions can be changed easily without replacing the plastic roll.

Similarly, magazines and articles of mail, as well as powders, grains, granular material, beads, and other small particles and components, are now being packaged in plastic envelopes. The conventional packaging machines generally include a compressed air source, and a plurality of pistons and pneumatic elements, resulting in an expensive and complex device.

SUMMARY OF THE INVENTION

According to the present invention, there is provided a device for forming plastic pouches including a source of at least two substantially superposed layers of plastic sheet, a pair of rollers for selectively advancing the layers of plastic sheet, a plastic filling element, and heat welding means for sealing open sides of the pouches, wherein portions of a longitudinal half of each of the rollers have a larger radius than the remainder of the roller whereby, when the larger radius portions of the rollers engage one another, they advance the plastic held between them, and when the smaller radius portions of the rollers are in registration with one another, they do not engage the plastic between them, so the plastic does not advance and can be heat sealed.

According to a preferred embodiment, the source of layers includes a roll of folded plastic sheet.

Further according to a preferred embodiment of the invention, the device includes a release mechanism for easy removal and replacement of one roller.

According to another embodiment of the invention, the heat sealing means are arranged to seal a plurality of adjacent bags simultaneously.

According to yet another preferred embodiment of the invention, the plastic filling element includes a blower or other source of air providing air between the layers of plastic to form air cushions.

According to a further embodiment of the invention, the plastic filling element includes a funnel or other source of filler material arranged to provide a quantity of the filler material between two plastic layers to form filled pouches.

Further according to the present invention, there is provided a method for forming plastic pouches including providing at least two substantially superposed layers of plastic sheet, rotating a pair of rollers, portions of one longitudinal half of each roller having a larger radius than the remainder of the roller, feeding the layers of plastic sheet between the rollers such that, when portions of the larger radius halves of the rollers overlap, they engage and advance the plastic sheet held between them, and when the larger radius portions of the rollers are not in registration, they do not engage plastic sheet, inserting material to be enclosed between two layers of plastic sheet, and heat sealing the open sides of the plastic sheets about the filler material so as to form a sealed pouch.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a device for forming plastic pouches for packaging (cushioning and void filling), which is relatively inexpensive, fast, requires no electronic controls, and which permits alteration of the size of the plastic pouches within seconds. Two particularly suitable applications for the device are the forming of air cushions (plastic pouches filled with air) and filled plastic pouches for packaging other filler material.

Figure 1:
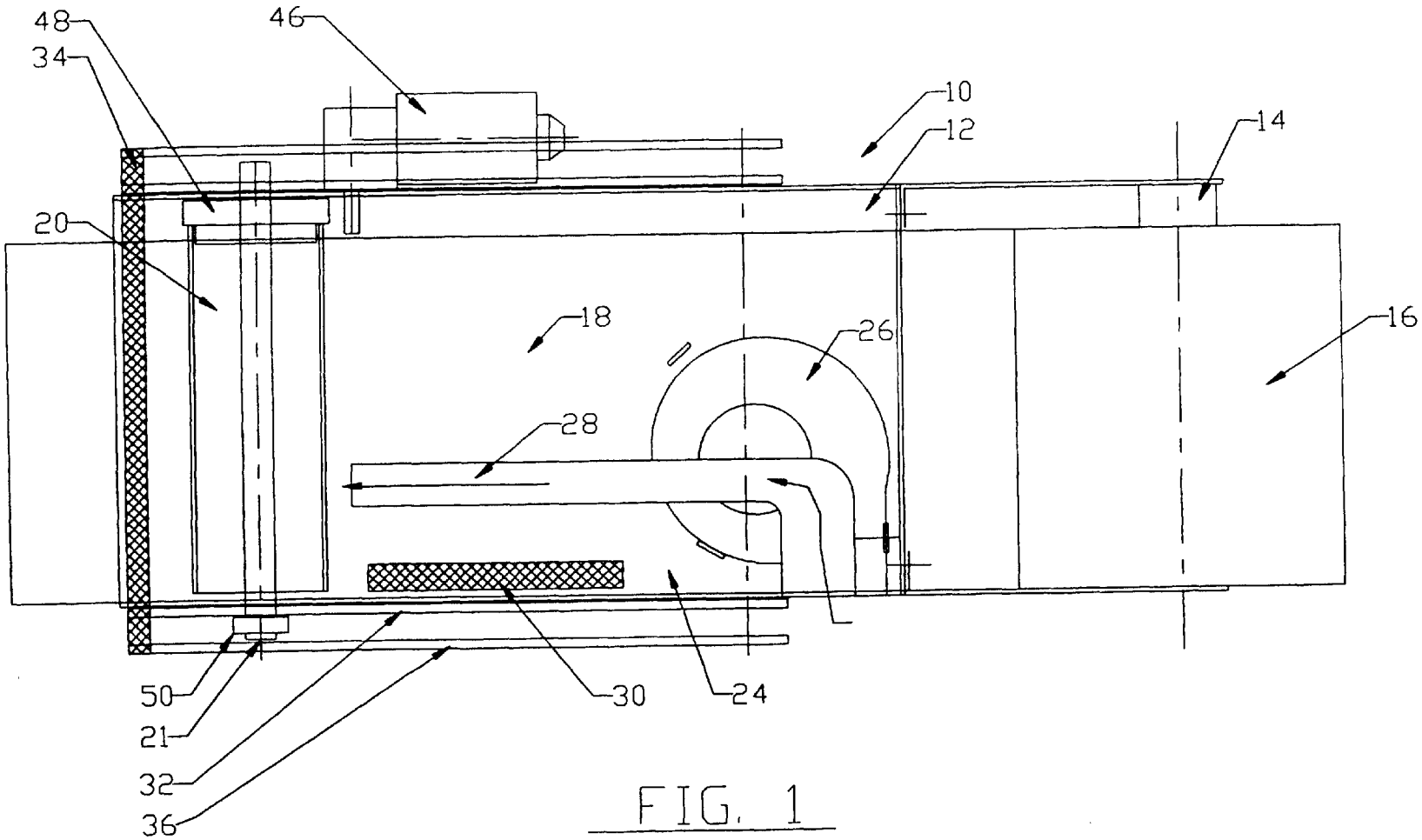
FIG. 1 is a top view of a packaging device, particularly for forming air cushions, constructed and operative in accordance with one embodiment of the invention.
Figure 2:
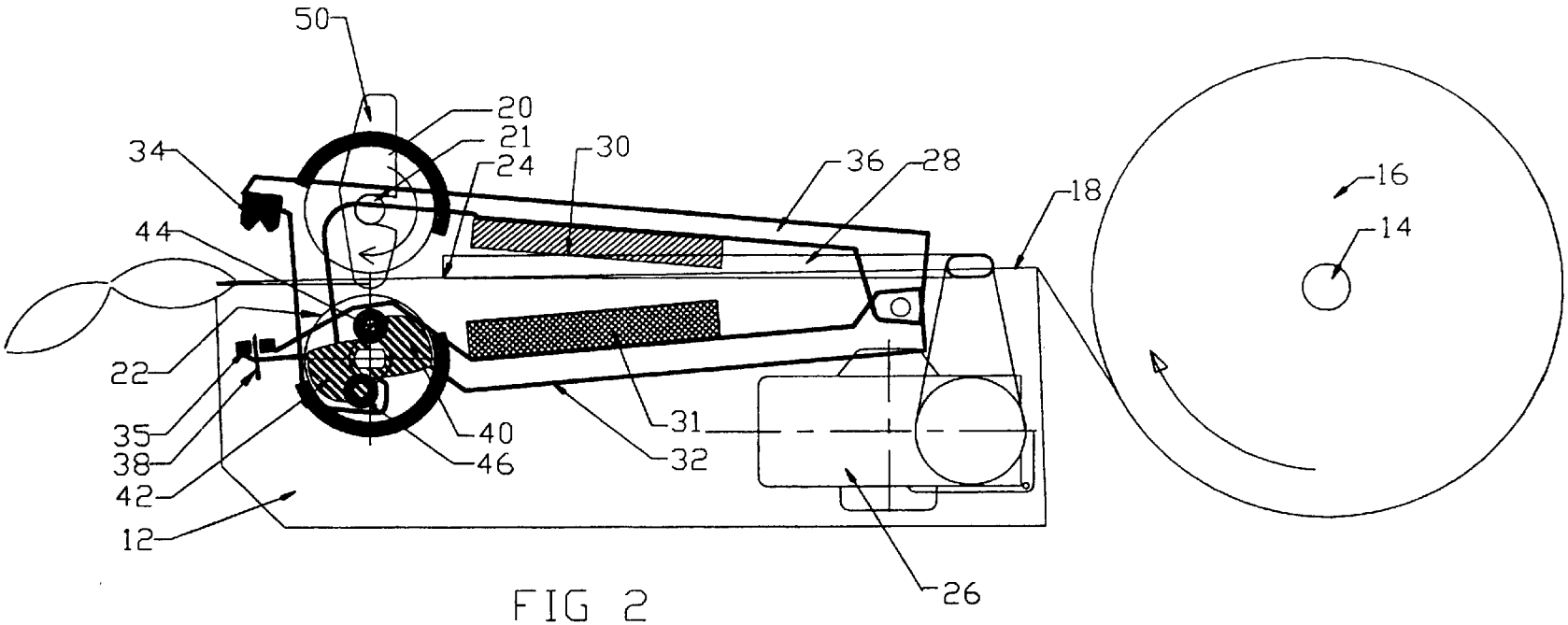
FIG. 2 is a schematic side view of the device of FIG. 1 in a plastic advancing orientation.

With reference to FIGS. 1 and 2, there is shown in respective top and side views a device 10 for forming air cushions constructed and operative in accordance with one embodiment of the invention. Device 10 includes a base 12 and a source 14 of at least two substantially superposed layers of plastic sheet material. Source 14 can be a single source of two layers of the same plastic material, it can be two separate sources of the same plastic material, it can be two separate sources of two different plastic materials, or it can be a plurality of sources of a variety of plastic materials, as required in the particular application. In the case of two layers, the plastic sheet material can be provided as two single sheets, a folded sheet, sealed along one side, or as a sleeve, sealed along two opposite sides.

In the embodiment of FIGS. 1 and 2, source 14 is a holder mounted on one end of the base 12 for holding a roll 16 of folded plastic sheet 18. A pair of rollers 20 and 22 (seen more clearly in FIG. 2) are mounted near the other end of base 12. As can be seen, one longitudinal half of each roller has a larger radius than the other half. A track 24 is provided between holder 14 and rollers 20, 22 over which plastic sheet 18 passes.

A blower 26, fan, or any other source of air, is provided in or adjacent base 12. It will be appreciated that while compressed air can be used in the invention, it is a particular feature of the invention that pressurized air is not required. Rather, a simple blower providing a stream of air is sufficient to inflate the air cushions on the device of the present invention.

A tube 28 extends from adjacent blower 26 and between the two halves of the folded plastic sheet 18 as it moves along track 24 to fill the air cushions. A longitudinal heat sealing bar 30 is mounted on a first arm 36 and arranged to seal the plastic sheet against a first anvil 31 affixed to a second arm 32 pivotably mounted on base 12. An axial heat sealing bar 34 is also affixed to first arm 36, and arranged to seal the plastic sheet against a second anvil 35 affixed to second arm 32. A cutting or perforating knife 38 can also be provided on second arm 32, if desired, to cut or perforate the plastic between air cushions.

In the illustrated embodiment, bar 30 seals the open side edge of the plastic sheet before it passes between the rollers, while bar 34 seals the remaining open edge of the preceding, filled air cushion which has already passed between the rollers. It will be appreciated, however, that the arrangement of heat sealing bars and anvils can be altered, if desired.

With further reference to FIG. 2, it can be seen that two cams 40, 42 are affixed on roller 22. A first cam follower 44 is mounted on first arm 36 for movement along first cam 40, and a second cam follower 46 is mounted on second arm 32 for movement along second cam 42. An electric motor 46 (FIG. 1), or other rotating means, mounted adjacent base 12, serves to rotate roller 22.

A toothed wheel 48 is wrapped around each end of each roller 20, 22. Toothed wheel 48 of roller 20 engages toothed wheel 48' of roller 22 for transmitting the rolling motion from one roller to the other. In this embodiment, toothed wheels 48 also serve to define the orientation of roller 20 relative to roller 22 (the amount of overlap of the greater radius) and thus, the size of the air cushions, as described below. It will be appreciated that, instead of gear wheels, a belt or any other mechanism permitting synchronization between the upper and lower elements so as to rotate the rollers at the same speed alternatively can be utilized.

Roller 20 is held in place by a release mechanism 50 which permits quick and easy removal and replacement of roller 20 above and in engagement with roller 22. In the illustrated embodiment, release mechanism 50 includes two hook members mounted on base 12 which releasably engage the axle 21 of the roller. When hook members 50 are pivoted out of engagement with axle 21, roller 20 can be lifted from roller 22. A new plastic sheet can then easily be inserted over roller 22, and/or roller 20 can be rotated relative to roller 22 to change the length of the air cushions produced, as described hereinbelow. Alternatively, any other releasable affixing means can be used to hold roller in place, such as screws.

Operation of the device of the present invention is as follows, with reference to FIGS. 2 and 3, which are schematic side views of the device of FIG. 1 in respective plastic advancing and plastic welding orientations. Roller 20 is removed by releasing release mechanism 50. A sheet 18 of folded plastic from roll 16 is passed along track 24 and over roller 22 in such a way that tube 28 passes between the top and bottom layers of folded plastic. The amount of overlap between the rollers is adjusted as to provide the desired length of air cushion. In this embodiment, roller 20 is replaced on roller 22, with toothed wheel 48 engaging toothed wheel 48' in the selected relative orientation, as described below.

Air from blower 26 passing through tube 28 serves to inflate the folded plastic as is moves along track 24. As rollers 20 and 22 turn with their large radius portions in registration (FIG. 2), rollers 20 and 22 engage the plastic sheet, and the sheet advances. First arm 36 and second arm 32 are pivoted such that heat seal bars 30 and 34 are out of engagement with anvils 31 and 35.

Figure 3:
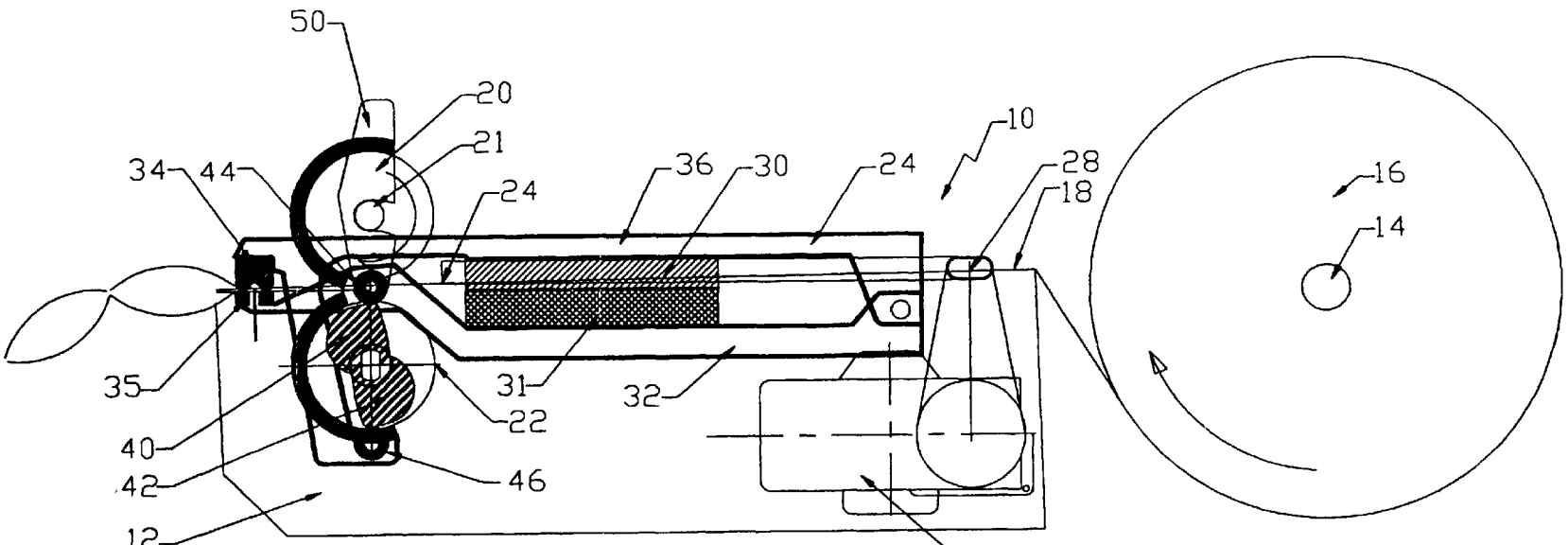
FIG. 3 is a schematic side view of the device of FIG. 1 in a heat welding orientation.

When the smaller radius of one roller overlaps (moves into register with) the second roller (or the smaller radius of both rollers is in register with each other), as in FIG. 3, plastic sheet 18 is no longer held between the rollers and continued motion of the rollers does not advance the plastic. Rather, the movement of cams 40 and 42 causes cam followers 44 and 46 on first and second arms 36 and 32 to mechanically move arms 36 and 32 to the heat sealing orientation wherein heat seal bars 30 and 34 engage anvils 31 and 35, thereby sealing an air cushion.

It is a particular feature of the invention that the entire advancing and sealing process is mechanical, not requiring any electronic or pneumatic devices for operation. This means that manufacture of the device of the present invention is substantially less expensive than conventional devices. It is a further particular feature that mechanical means to adjust the overlap of the rollers is provided to permit easy selection of the length of the pouches to be formed.

Figure 4A:
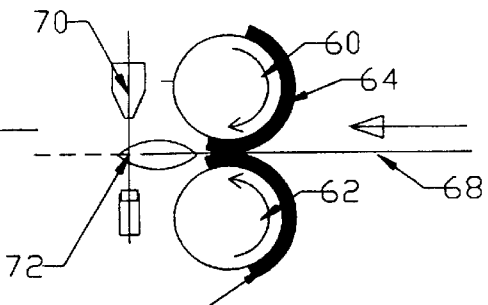
FIGS. 4*a*, 4*b* and 4*c* are schematic illustrations of the operation of the device of the present invention to form air cushions of one length.
Figure 4B:
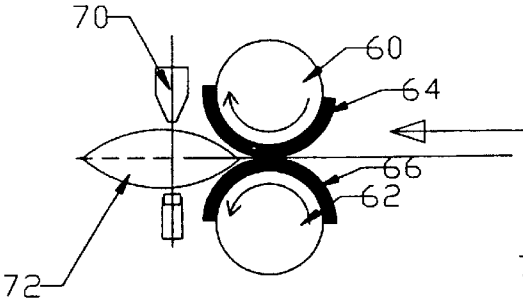
Figure 4C:
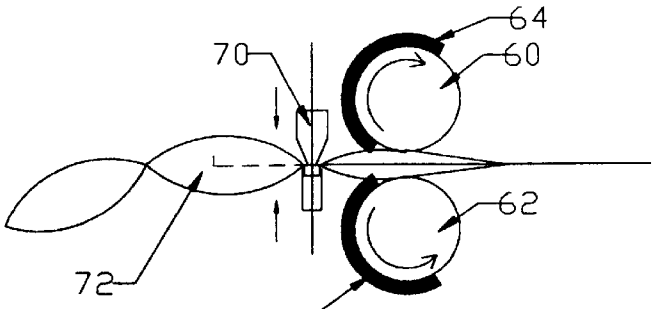

Referring now to FIGS. 4*a*, 4*b* and 4*c*, there are shown schematic illustrations of the operation of the device of the present invention to form air cushions of a certain length. As can be seen, in the illustrated embodiment, each roller 60 and 62 is covered over half of its diameter with a layer 64, 66 of rubber or non-smooth metal or any other material which provides frictional engagement of the plastic sheet. It will be appreciated that rollers having one longitudinal half of different radius than the other can be formed in any known manner. The change of radius permits the user to change the overlap of the enlarged radii, and thereby to determine the length of plastic sheet which is advanced at any given time.

Figures 7A, 7B:
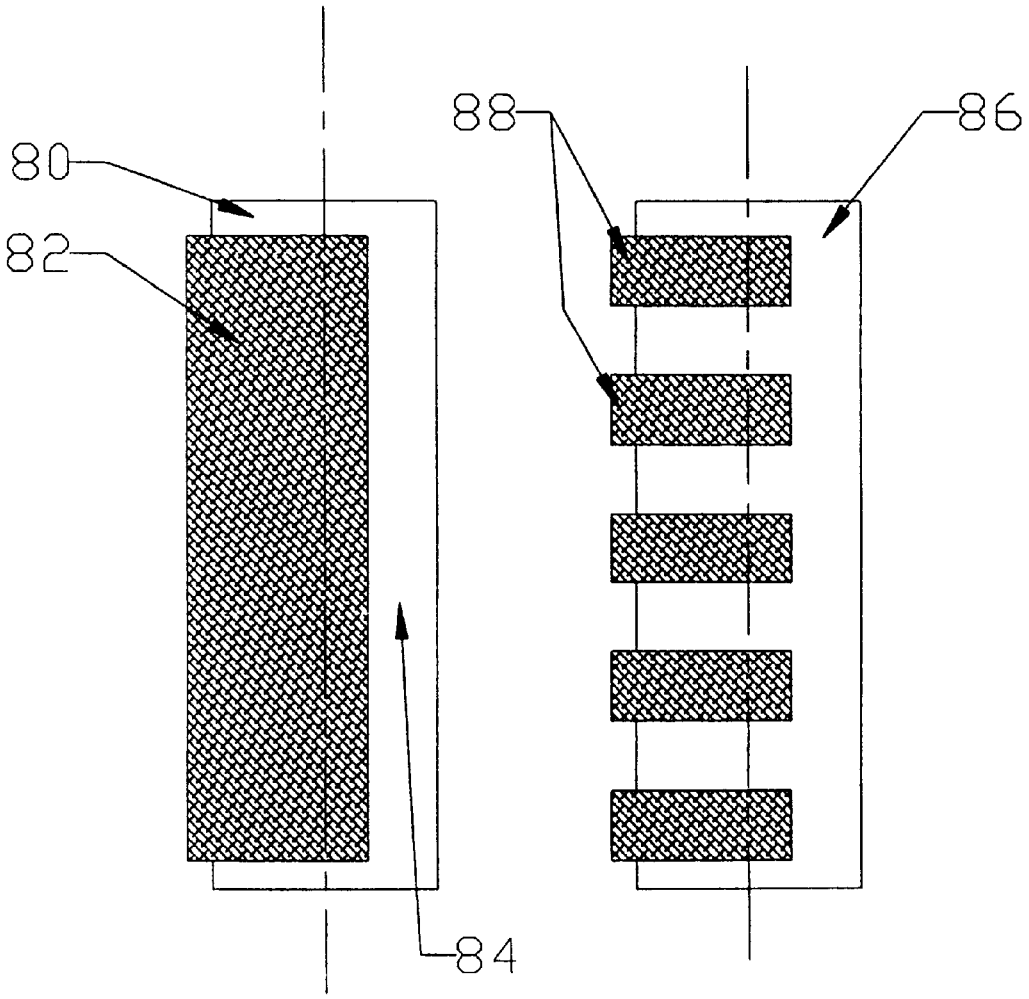
FIGS. 7*a* and 7*b* are schematic illustrations of two embodiments of rollers according to the present invention.

According to one embodiment of the invention, illustrated schematically in FIG. 7*a*, a full longitudinal half 82 (half of the diameter) of each roller 80 has larger radius than the other half 84. According to a preferred embodiment, illustrated schematically in FIG. 7*b*, a plurality of raised strips 88 or half rings are provided along one longitudinal half of roller 86. These strips can be formed, for example, of metal bolted onto roller 86 and covered with rubber pads which are glued onto the metal strips.

As seen in FIG. 4*a*, a folded plastic sheet 68 is engaged between rollers 20 and 22 at the time their enlarged radii overlap. As rollers 20 and 22 rotate, plastic sheet 68 is advanced (FIG. 4*b*) and filled with air from the blower. During these stages, the heat sealing bar 70 is open, and the air cushion 72 passes through it.

When the smaller radii of rollers 60 and 62 are in register with one another, FIG. 4*c*, plastic sheet 68 is no longer frictionally engaged therebetween, and the rollers rotate without advancing the plastic. However, as described above, the cam followers cause the heat sealing bar 70 to close, thereby sealing air cushion 72. Thus, in each rotation of the rollers, advancement, sealing, and perforating or cutting of the plastic sheet occur.

Figure 5:
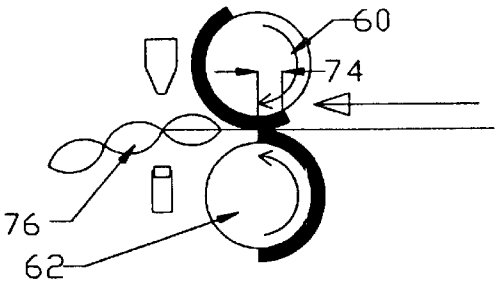
FIG. 5 is a schematic illustration of the operation of the device of the present invention to form air cushions of a different length.

FIG. 5 is a schematic illustration of the operation of the device of the present invention to form air cushions of a different length. As can be seen, roller 60' has been rotated relative to roller 62'. Thus, while in FIGS. 4*a* to 4*c*, the entire enlarged diameter surface of each roller overlapped the other, in FIG. 5, only a relatively small overlap 74 exists. This results in air cushions 76 of much shorter length, since the plastic is only advanced during the time of roller overlap. As stated above, the provision of toothed wheels around each roller permits the easy adjustment of the length of the air cushion, by permitting controlled determination of the overlap of the expanded diameter portions of the rollers.

It will be appreciated that the diameter of the rollers determines the maximum possible length of the air cushions produced. The minimum length depends on the selected area of overlap of the expanded radii.

Figure 6:
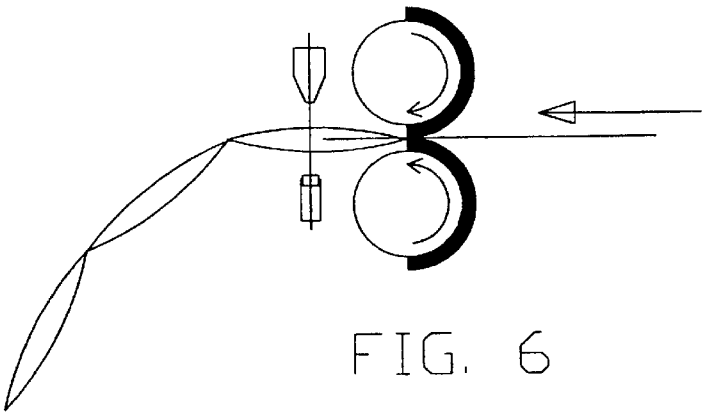
FIG. 6 is a schematic illustration of a packaging device constructed and operative in accordance with an alternative embodiment of the invention.

In an alternative embodiment of the invention, shown schematically in FIG. 6, instead of air, an object or magazine to be wrapped is inserted between the folds of the plastic sheet and sealed beyond the rollers. In this case, the object can be inserted manually or mechanically.

Figure 8A:
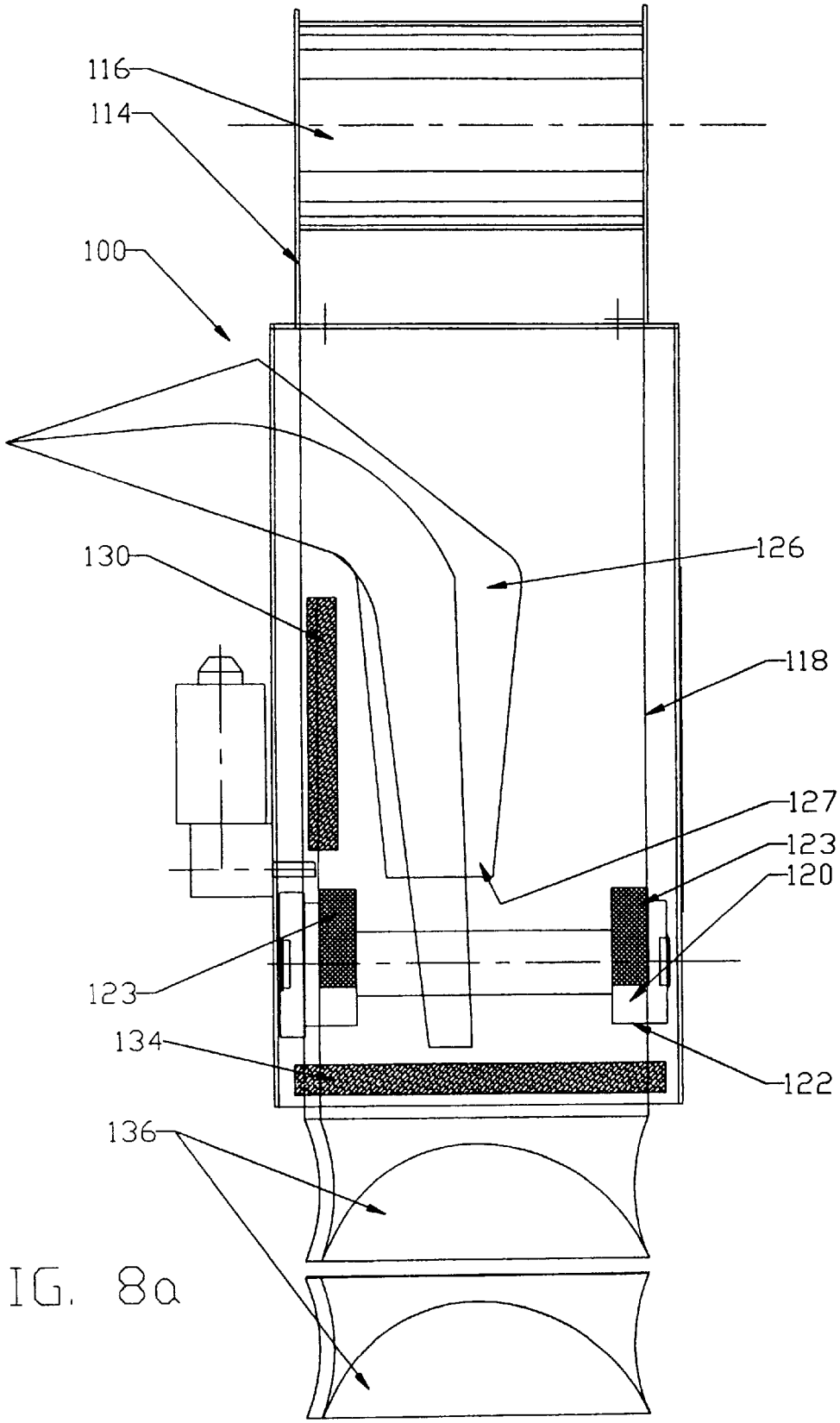
FIG. 8*a* is a schematic plan view of a packaging device, particularly for forming filled pouches, constructed and operative in accordance with one embodiment of the invention.
Figure 8B:
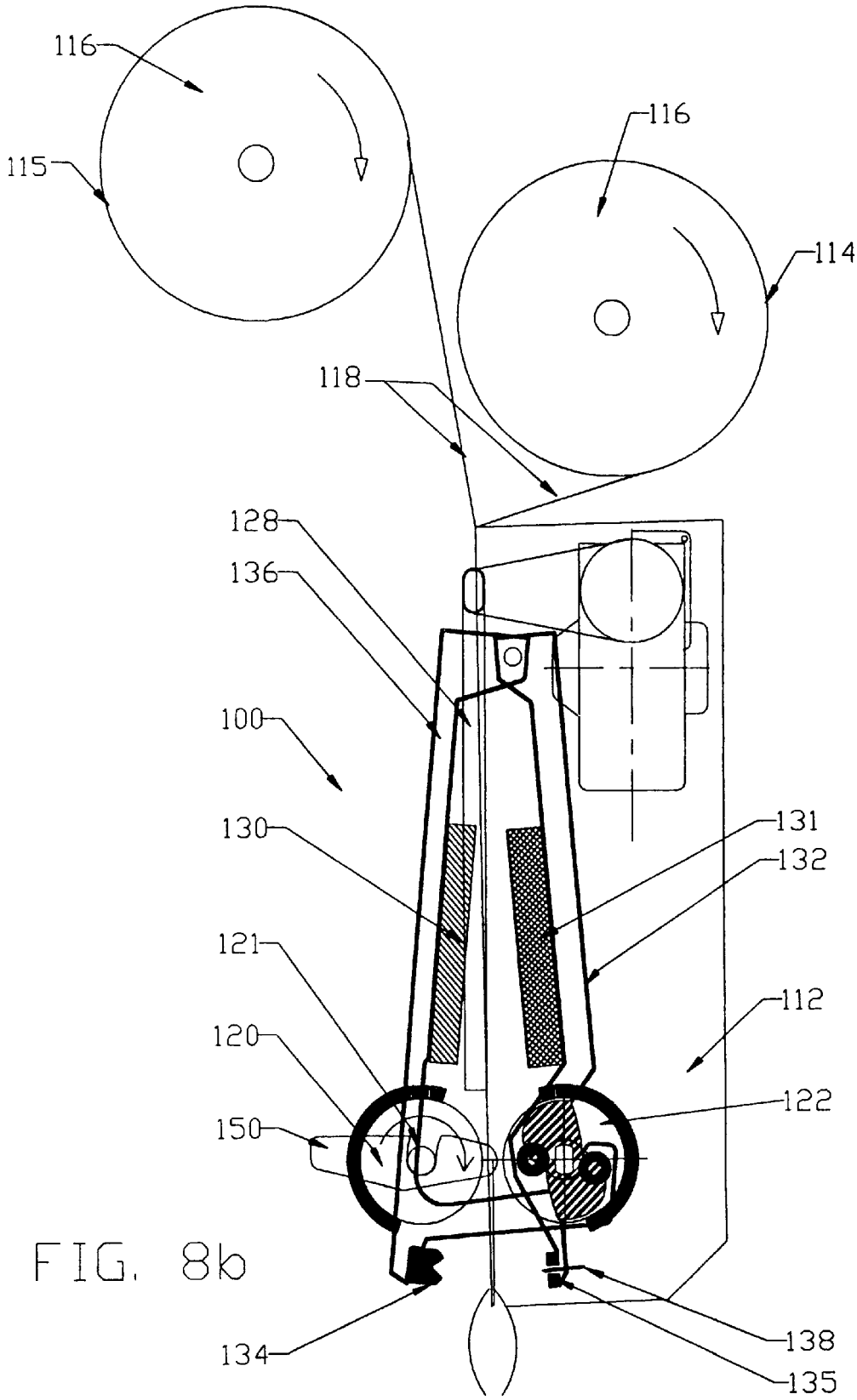
FIG. 8*b* is a schematic side view of the packaging device of FIG. 8*a*.

Referring now to FIGS. 8*a* and 8*b*, there are shown respective schematic plan and side views of a packaging device 100 for forming filled pouches, constructed and operative in accordance with one embodiment of the invention. Packaging device 100 includes a vertical base 112 and sources 114 and 115 of two substantially superposed layers of plastic sheet material. In the embodiment of FIG. 8*a*, sources 114 and 115 are a pair of holders mounted on one end of the base 112, each for holding one roll 116 of plastic sheet 118. A pair of rollers 120 and 122 are mounted near the other end of base 112. As can be seen, in this embodiment of the invention, rollers 120 and 122 each have only two strips 123 of enlarged radius at opposite ends of the rollers.

A funnel 126, or any other source of filler material 124, is provided adjacent base 112, with its spout 127 between strips 123 on rollers 120 and 122. In the illustrated embodiment, the vertical arrangement of the base 112 permits the filling of pouches by means of gravity. Filler material 124 can be any solid, liquid, particles, components, gas, or any other material desired to be sealed in a plastic pouch. A blower with air tube 128 is mounted on base 112 to provide an opening between two plastic sheets into which the filler material can be inserted.

A longitudinal heat sealing bar 130 is mounted on a first arm 136 and arranged to seal the open side of the plastic sheets against a first anvil 131 affixed to a second arm 132 pivotably mounted on base 112. If the plastic sheets are separate sheets, another longitudinal heat sealing bar must be provided to seal the opposite edges of the plastic sheets, such that a plastic sleeve reaches rollers 120 and 122 and spout 127 of funnel 126.

An axial heat sealing bar 134 is also affixed to the first arm 136, and arranged to seal the plastic sheet against a second anvil 135 affixed to the second arm. A cutting or perforating knife 138 can also be provided on the second arm 132, if desired, to cut or perforate the plastic between air cushions.

In the illustrated embodiment, bar 130 seals the open side edge of the plastic sheet before it passes between the rollers, while bar 134 seals the remaining open edge of the preceding, filled air cushion 136 which has already passed between the rollers. It will be appreciated, however, that the arrangement of heat sealing bars and anvils can be altered, if desired.

It will be appreciated that the invention is not limited to what has been described hereinabove merely by way of example. Rather, the invention is limited solely by the claims which follow.

What is claimed is:

1. A device for forming plastic pouches comprising:

a source of at least two substantially superposed layers of plastic sheet;

a pair of rollers for selectively advancing the layers of plastic sheet, portions of one longitudinal half of each of the rollers having a larger radius than the remainder of the roller whereby, when portions of the larger radius halves of the rollers overlap, they engage and advance the plastic held between them, and when the larger radius portions of the rollers are not in registration, they do not engage the plastic sheet; and heat sealing means for sealing the open sides of the plastic sheet.

2. The device according to claim 1, further comprising means for inserting a filler material between two of said layers of plastic sheet before sealing.

3. The device according to claim 2, wherein said means for inserting a filler material includes a source of air providing air inside the folded plastic sheet.

4. The device according to claim 2, wherein said means for inserting a filler material includes a funnel for feeding a filler material between two of said layers of plastic sheet.

5. The device according to claim 1, wherein said source comprises a holder for a roll of folded plastic sheet mounted on said base.

6. The device according to claim 5, further comprising:

a base, to which said holder and said rollers are coupled;

first and second cams mounted on one of said rollers;

a first arm pivotably coupled at one end to said base and further coupled to a cam follower associated with said first cam;

a second arm pivotably coupled at one end to said base and further coupled to a cam follower associated with said second cam;

a longitudinal heat seal bar and an axial heat seal bar mounted on said first arm;

a longitudinal anvil and an axial anvil on said second arm; and apparatus for rotating said rollers, thereby causing said first and second arms to bring said heat seal bars together with said associated anvil.

7. The device according to claim 1, wherein said source comprises at least one holder mounted on said base, one holder for each roll of plastic sheet.

8. The device according to claim 1, further comprising a release mechanism for easy removal and replacement of one roller.

9. The device according to claim 1, further comprising means for adjusting the amount of overlap between said rollers.

10. The device according to claim 1, wherein said portion of a longitudinal half of each of the rollers includes a substantially full half of said roller.

11. The device according to claim 1, wherein said portion of a longitudinal half of each of the rollers includes a plurality of half-rings extending from one longitudinal half of said roller.

12. A device for forming plastic air cushions comprising:

a source of at least two substantially superposed plastic sheets;

a pair of rollers for selectively advancing said plastic sheets, wherein a portion of a longitudinal half of each of the rollers has a larger radius than the remainder of the roller, whereby when the larger radius portions of the rollers overlap, they engage and advance plastic sheets held between them, and when the smaller radius portions of the rollers are in registration with one another, they do not engage the plastic sheets;

a track extending between said source and said rollers;

a source of air providing air between said layers; and heat sealing means for sealing open sides of said plastic sheets.

13. The device according to claim 12, further comprising a release mechanism for easy removal and replacement of one roller.

14. The device according to claim 12, further comprising means for adjusting the amount of overlap between said rollers.

15. The device according to claim 12, wherein said portion of a longitudinal half of each of the rollers includes a substantially full half of said roller.

16. The device according to claim 12, wherein said portion of a longitudinal half of each of the rollers includes a plurality of half-rings extending from one longitudinal half of said roller.

17. A method for forming plastic pouches comprising:

providing two substantially superposed lengths of plastic sheet;

rotating a pair of rollers, a portion of one longitudinal half of each roller having a larger radius than the remainder of the roller;

feeding said lengths of plastic sheet between said rollers such that, when portions of the larger radius halves of the rollers overlap, they engage and advance said plastic sheets held between them, and when the larger radius portions of the rollers are not in registration, they do not engage plastic sheets;

inserting material to be enclosed between said layers of plastic sheet; and heat sealing the open sides of said plastic sheets about said material so as to form a closed pouch.

18. The method of claim 17, wherein said step of heat sealing includes simultaneously heat sealing a longitudinal side of a portion of said plastic sheets which has not passed between said rollers, and heat sealing an axial side of said plastic sheets after it has passed between said rollers.

19. The method of claim 17, wherein said step of inserting material includes blowing air between said layers.

20. The method of claim 17, wherein said step of inserting material includes inserting a filler material.

21. The method of claim 17, wherein said step of heat sealing includes:

mounting first and second cams on one of said rollers;

mounting a longitudinal and an axial heat seal bar on a first arm coupled to a cam follower for following said first cam;

mounting a longitudinal and an axial anvil on a second arm coupled to a cam follower for following said second cam; and rotating said rollers, whereby said cam followers cause said first and second arms to bring said heat seal bars and said anvils together.

* * * * *